US007871262B2

(12) United States Patent
Carroni et al.

(10) Patent No.: US 7,871,262 B2
(45) Date of Patent: Jan. 18, 2011

(54) METHOD AND DEVICE FOR BURNING HYDROGEN IN A PREMIX BURNER

(75) Inventors: Richard Carroni, Niederrohrdorf (CH); Timothy Griffin, Ennetbaden (CH)

(73) Assignee: ALSTOM Technology Ltd., Baden (CH)

( * ) Notice: Subject to any disclaimer, the term of this patent is extended or adjusted under 35 U.S.C. 154(b) by 40 days.

(21) Appl. No.: 11/752,359

(22) Filed: May 23, 2007

(65) Prior Publication Data

US 2008/0280239 A1 Nov. 13, 2008

Related U.S. Application Data

(63) Continuation of application No. PCT/EP2005/055985, filed on Nov. 15, 2005.

(30) Foreign Application Priority Data

Nov. 30, 2004 (CH) ..... 1971/04

(51) Int. Cl.
*F23D 14/02* (2006.01)
*F23D 17/00* (2006.01)
*F23C 7/00* (2006.01)

(52) U.S. Cl. ..... 431/9; 431/1; 431/187; 431/188; 431/350; 431/354

(58) Field of Classification Search ..... 431/350, 431/354, 187, 188, 1, 9
See application file for complete search history.

(56) References Cited

U.S. PATENT DOCUMENTS 4,297,093 A * 10/1981 Morimoto et al. ..... 431/10
5,044,931 A * 9/1991 Van Eerden et al. ..... 431/8
5,375,995 A * 12/1994 Dobbeling et al. ..... 431/8
5,415,114 A * 5/1995 Monro et al. ..... 110/347
5,433,596 A * 7/1995 Dobbeling et al. ..... 431/350
5,489,203 A * 2/1996 Dobbeling et al. ..... 431/173

(Continued)

FOREIGN PATENT DOCUMENTS

DE 4409918 9/1995

(Continued)

OTHER PUBLICATIONS

Search Report for Swiss Patent App. 01971/04 (Mar. 15, 2005).

(Continued)

*Primary Examiner*—Steven B McAllister
*Assistant Examiner*—Daniel E Namay
(74) *Attorney, Agent, or Firm*—Cermak Nakajima LLP; Adam J. Cermak

(57) ABSTRACT

A method and a device for combusting gaseous fuel which contains hydrogen or consists of hydrogen, includes a burner which provides a swirl generator (1) into which liquid fuel is feedable centrally along a burner axis (A), forming a liquid fuel column which is conically formed and which is enveloped by, and mixed through with, a rotating combustion air flow which flows tangentially into the swirl generator (1). The gaseous fuel is fed inside the swirl generator (1) largely axially and/or coaxially to the burner axis (A), forming a fuel flow with a largely spatially defined flow pattern (9) which is maintained inside the burner and bursts open in the region of the burner outlet.

25 Claims, 6 Drawing Sheets

U.S. PATENT DOCUMENTS

| | | | | | |
|---|---|---|---|---|---|
| 5,500,030 | A * | 3/1996 | Joshi et al. | 65/346 |
| 5,516,281 | A * | 5/1996 | Molodow | 431/350 |
| 5,562,441 | A * | 10/1996 | Dobbeling et al. | 431/351 |
| 5,782,627 | A * | 7/1998 | Dobbeling et al. | 431/9 |
| 5,800,160 | A * | 9/1998 | Knopfel et al. | 431/351 |
| 5,807,097 | A * | 9/1998 | Dobbeling et al. | 431/351 |
| 5,921,770 | A * | 7/1999 | Sattelmayer | 431/352 |
| 5,954,490 | A * | 9/1999 | Knopfel et al. | 431/115 |
| 5,954,496 | A * | 9/1999 | Dobbeling et al. | 431/354 |
| 6,019,596 | A * | 2/2000 | Knopfel et al. | 431/350 |
| 6,027,331 | A * | 2/2000 | Dobbeling et al. | 431/182 |
| 6,059,565 | A * | 5/2000 | Knopfel et al. | 431/350 |
| 6,102,692 | A * | 8/2000 | Dobbeling et al. | 431/350 |
| 6,152,726 | A * | 11/2000 | Ruck et al. | 431/284 |
| 6,155,212 | A * | 12/2000 | McAlister | 123/3 |
| 6,186,775 | B1 * | 2/2001 | Jansohn et al. | 431/285 |
| 6,270,338 | B1 * | 8/2001 | Eroglu et al. | 431/8 |
| 6,331,109 | B1 * | 12/2001 | Paikert et al. | 431/350 |
| 6,461,151 | B1 * | 10/2002 | Knoepfel et al. | 431/350 |
| 6,609,905 | B2 * | 8/2003 | Eroglu et al. | 431/284 |
| 6,625,988 | B2 * | 9/2003 | Weisenstein et al. | 60/777 |
| 6,679,061 | B2 * | 1/2004 | Steinbach et al. | 60/777 |
| 6,705,857 | B2 * | 3/2004 | Paschereit et al. | 431/350 |
| 6,729,874 | B2 * | 5/2004 | Poe et al. | 431/354 |
| 6,769,903 | B2 * | 8/2004 | Eroglu et al. | 431/8 |
| 6,790,030 | B2 * | 9/2004 | Fischer et al. | 431/8 |
| 6,901,760 | B2 * | 6/2005 | Dittmann et al. | 60/773 |
| 7,241,138 | B2 * | 7/2007 | Flohr et al. | 431/350 |
| 2002/0064738 | A1 * | 5/2002 | Hugens, Jr. | 431/2 |
| 2002/0124549 | A1 * | 9/2002 | Dittmann et al. | 60/39.23 |
| 2002/0172905 | A1 * | 11/2002 | Ruck et al. | 431/354 |
| 2003/0031972 | A1 * | 2/2003 | Griffin et al. | 431/354 |
| 2003/0148236 | A1 * | 8/2003 | Joshi et al. | 431/9 |
| 2004/0137395 | A1 * | 7/2004 | Flohr et al. | 431/159 |
| 2004/0146826 | A1 * | 7/2004 | Poe et al. | 431/354 |
| 2005/0026095 | A1 * | 2/2005 | Fischer et al. | 431/2 |

FOREIGN PATENT DOCUMENTS

| | | | |
|---|---|---|---|
| DE | 4435473 | A1 * | 4/1996 |
| DE | 19527453 | A1 * | 1/1997 |
| DE | EP908671 | * | 4/1999 |
| DE | 19757189 | A1 * | 6/1999 |
| DE | 19917662 | A1 * | 11/2000 |
| DE | 10042315 | A1 * | 3/2002 |
| EP | 0321809 | | 6/1989 |
| EP | 0610722 | | 8/1994 |
| EP | 0780629 | | 6/1997 |
| EP | 780630 | A2 * | 6/1997 |
| EP | 797051 | A2 * | 9/1997 |
| EP | 833104 | A2 * | 4/1998 |
| EP | 866268 | A1 * | 9/1998 |
| EP | 881432 | A2 * | 12/1998 |
| EP | 0908671 | | 4/1999 |
| EP | 918190 | A1 * | 5/1999 |
| EP | 994300 | A1 * | 4/2000 |
| EP | 1002992 | A1 * | 5/2000 |
| EP | 1070914 | A1 * | 1/2001 |
| EP | 1070915 | | 1/2001 |
| EP | 1217297 | A1 * | 6/2002 |
| GB | 2350179 | A * | 11/2000 |
| JP | 10103620 | A * | 4/1998 |
| JP | 10110912 | A * | 4/1998 |
| WO | WO93/17279 | | 9/1993 |
| WO | WO 00/39503 | A1 * | 7/2000 |
| WO | WO2006/058843 | | 6/2006 |

OTHER PUBLICATIONS

International Search Report for PCT Patent App. No. PCT/EP2005/055985 (May 4, 2006).

International Preliminary Report on Patentability for PCT Patent App. No. PCT/ EP2005/055985 (Mar. 2, 2007).

* cited by examiner a)

b)

METHOD AND DEVICE FOR BURNING HYDROGEN IN A PREMIX BURNER

This application is a Continuation of, and claims priority under 35 U.S.C. §120 to, International application number PCT/EP2005/055985, filed 15 Nov. 2005, and claims priority therethrough under 35 U.S.C. §119 to Swiss application number 01971/04, filed 30 Nov. 2004, the entireties of which are incorporated by reference herein.

BACKGROUND

1. Field of Endeavor

The invention relates to a method and also a device for combusting gaseous fuel, which contains hydrogen or consists of hydrogen, with a burner which provides a swirl generator into which liquid fuel, for example mineral oil, is feedable centrally along a burner axis, forming a liquid fuel column which is conically formed, and which is enveloped by, and mixed through with, a rotating combustion air flow which flows tangentially into the swirl generator. Furthermore, devices for feeding gaseous fuel, for example natural gas, are provided in the combustion air flow which enters the swirl generator through tangential air inlet slots.

2. Brief Description of the Related Art

Motivated by the almost worldwide endeavor with regard to the reduction of emission of greenhouse gases into the atmosphere, not least of all established in the so-called Kyoto Protocol, the emission of greenhouse gases which is to be expected in the year 2010 is to be reduced to the same level as in the year 1990. To implement this plan, it requires greater efforts, especially to reduce the contribution to anthropogenic-related $CO_2$ releases. Approximately a third of the $CO_2$ which is released by people into the atmosphere is directed back for energy generation, in which mostly fossil fuels are combusted in power generating plants for the generation of electricity. Especially by the use of modern technologies and also by additional political parameters, a significant potential for economy for avoiding a further increasing of $CO_2$ emission can be seen by the energy-generating sector.

An as known per se and technically controllable possibility to reduce the $CO_2$ emission in combustion power plants consists in the extraction of carbon from the fuels, which are obtained for combustion, before introducing the fuel into the combustion chamber. This requires corresponding pretreatments of fuel, as, for example, the partial oxidation of the fuel with oxygen and/or a pretreatment of the fuel with water vapor. Such pretreated fuels mostly have a large portion of $H_2$ and CO, and depending upon mixing ratios, have calorific values which, as a rule, are below those of normal natural gas. In dependence upon their calorific value, gases which are synthetically produced in such a way are referred to as Mbtu or Lbtu gases, which are not simply suitable for use in conventional burners which are designed for the combustion of normal gases such as natural gas, as they can be gathered, for example, from EP 0 321 809 B1, EP 0 780 629 A2, WO 93/17279 and also EP 1 070 915 A1. In all of the preceding documents, burners of the fuel premixing type are described, in which a swirled flow of combustion air and admixed fuel, which conically expands in the flow direction, is generated in each case, which swirled flow becomes unstable in the flow direction by means of the increasing swirl after exit from the burner, as far as possible after achieving a homogenous air-fuel mixture, and changes into an annular swirled flow with backflow in the core.

Depending upon the burner concept and also in dependence upon the burner capacity, the swirled flow of liquid and/or gaseous fuel, which is formed inside the premix burner, is fed for forming a fuel-air mixture which is as homogenous as possible. However, as previously mentioned, it is necessary to use synthetically prepared gaseous fuels alternatively to or in combination with the combustion of conventional fuel types for the purpose of a reduced emission of pollutants, especially the emission of $CO_2$, so special requirements arise for the constructional design of conventional premix burner systems. Consequently, for feed into burner systems, synthesis gases require a multiple volumetric flow of fuel compared with comparable burners which are operated with natural gas, so that appreciably different flow impulse conditions are created. On account of the high portion of hydrogen in the synthesis gas, and the low ignition temperature and high flame velocity of the hydrogen which are connected with it, there is a high reaction tendency of the fuel, which leads to an increased risk of backflash. In order to avoid this, it is necessary to reduce as far as possible the average retention time of ignitable fuel-air mixture inside the burner.

A method and also a burner for combustion of gaseous fuel, liquid fuel, and also medium-calorific or low-calorific fuel, is described in EP 0 908 671 B1. In this case, a double-cone burner with a downstream mixing path according to EP 0 780 629 A2 is used, in the swirl shells of which, which define the swirl chamber, feed pipes for axial and/or coaxial injection of medium-calorific or low-calorific fuel into the inside of the swirl generator are provided. A schematic assembly of such a premix burner arrangement is shown in FIGS. 2 and 3 herein. FIG. 2 shows a longitudinal section, FIG. 3 shows a cross section through the premix burner arrangement which provides a conically widening swirl generator 1 which is defined by swirl shells 2. Devices for feeding fuel are provided axially and also coaxially around the center axis A of the swirl generator 1. Therefore, liquid fuel $B_L$ reaches the swirl chamber by means of an injection nozzle 3 which is positioned along the burner axis A at the location of the smallest inside diameter of the swirl generator 1. Gaseous fuel $B_G$, preferably in the form of natural gas, is admixed with the combustion air along tangential air inlet slots 4 through which combustion air L enters the swirl chamber with a tangential flow direction. Injection devices 5 are additionally provided, which are coaxially arranged around the burner axis A and serve for the additional feed of medium-calorific fuel $B_M$.

The fuel-air mixture which is formed inside the swirl generator 1 reaches a mixer tube 8, in the form of a swirled flow, through a transition piece 6 which provides the flow medium 7 which stabilizes the swirled flow, in which mixer tube a complete homogenous mixing through is carried out of the fuel-air mixture which is formed, before the ignitable fuel-air mixture is ignited inside a combustion chamber (not shown) which is connected downstream to the mixer tube 8. FIG. 3 shows a cross section through the swirl generator 1 in the region of the injection devices 5 which penetrate the swirl shells 2. The air inlet slots 4, through which air L penetrates into the inside of the swirl generator 1, are better visible in the cross sectional view. Gaseous fuel $B_G$, via corresponding feed pipes, is admixed together with the combustion air L at the location of the air inlet slots 4. An injection nozzle for the delivery of liquid fuel into the inside of the swirl generator 1 is provided centrally to the burner axis A.

The combustion of medium-calorific fuels, the calorific values of which are typically between 5 MJ/kg and 15 MJ/kg, is indeed possible with the previously described burner concept in hybrid operating mode alone or in combination with the combustion of liquid fuel and natural gas, yet extensive combustion trials have revealed that, while endeavoring to use fuels which are as carbon-free as possible and which in addition have a hydrogen portion which is as large as possible and which preferably consist completely of hydrogen, the use of the previously described premix burner is not suitable. Since fuels which are rich in hydrogen, with a hydrogen portion of more than 50 percent, have such a high reactivity and also a very much higher flame velocity, which typically is twice as much as that of flames which are operated with medium-calorific synthesis gases, and, furthermore, have a very much lower volume of specific heat calorific value (MJ/$m^3$), there is a need for a very much larger quantity of hydrogen which has to be fed to the burner for achieving a desired combustion heat. Especially when using fuel which exclusively consists of hydrogen, high-pressure trials on a generic type premix burner for operating a gas turbine plant, the operation of which requires high firing temperatures, showed that ignition phenomena already occur in the swirl chamber or along the mixing path of the burner, as the case may be, which are attributed to an inadequate mixing of the hydrogen which is fed axialwards into the burner with large volumetric flow. Even in cases in which no backflash phenomena occur, inadequate mixing of hydrogen and combustion air provides a diffusion-like combustion, which ultimately leads to increased emissions of nitrogen oxide.

SUMMARY

Starting from this prior art, one of numerous aspects of the present invention includes a premix burner in which the above disadvantages do not occur, and which especially when operating with a fuel which contains hydrogen, with a hydrogen portion of at least 50 percent or with a gaseous fuel which exclusively consists of hydrogen, as the case may be, ensures an improved mixing through with the combustion air, and at the same time provides stable flow conditions.

Features which advantageously develop the inventive idea are to be gathered from the description, especially with reference to the exemplary embodiments.

Despite the trial results which were gained in the approach to a conventional premix burner according to the type of construction of EP 0 908 671 B1, as mentioned in the introduction, the burner concept according to the present invention does not move away from the principle of fuel feed of fuel which contains hydrogen, preferably fuel which consists of hydrogen, into the swirl chamber, which feed is axial and/or coaxial to the burner axis. Of importance is the type and manner in which form, and with which degree of mixing through of the fuel, which contains hydrogen or entirely consists of hydrogen, as the case may be, is fed into the burner. For the simplified description of the invention, hydrogen or hydrogen fuel is subsequently exclusively spoken of, by which is meant that the fuel comprises a hydrogen portion of at least 50 percent, preferably entirely consists of hydrogen, that is, 100 percent hydrogen.

In order to ensure a desirable clean and safe combustion of hydrogen, it is necessary to carry out the feed of hydrogen which is oriented axially and/or coaxially to the burner axis in such a way that on one hand the feed velocity of hydrogen is appreciably increased, and on the other hand the mixing through rate between hydrogen and combustion air is significantly increased. These measures lead to an appreciably improved homogeneity in the mixed through fuel-air mixture before achieving the flame front downstream of the burner.

An exemplary method according to the present invention for combusting gaseous fuel, which contains hydrogen or consists of hydrogen, with a burner which provides a swirl generator, into which liquid fuel is feedable centrally along a burner axis, forming a liquid fuel column which is conically formed, and which is enveloped by, and mixed through with, a rotating combustion air flow which flows tangentially into the swirl generator, provides a feed inside the swirl generator of gaseous fuel, which contains hydrogen or consists of hydrogen, which feed is oriented axially and/or coaxially to the burner axis, forming a fuel flow with a largely spatially defined flow pattern which is maintained inside the burner and bursts open into a turbulent flow pattern only in the region of the burner outlet.

The arrangement and dimensioning of the hydrogen feed into the swirl generator of the burner which is required for this, is to be selected in a manner and to be integrated into the burner so that the constructional form of the burner which is optimized for combustion of liquid fuel and also natural gas is not negatively affected, or only slightly so. This means that the shape, arrangement, and dimension of the swirl generator, transition piece, and mixer tube, as, for example, they can be gathered from FIG. 2, remain largely unaltered, with exception of the devices which lead through the swirl shells into the inside of the swirl generator for feed of hydrogen or fuel and which predominantly contain hydrogen.

The feed of hydrogen is carried out in such a way that as directly as possible after issue of the hydrogen from the feed pipes an efficient mixing through of the hydrogen with the combustion air takes place in order to avoid local hydrogen concentrations inside the burner, which are the cause of advanced ignition phenomena by way of spontaneous ignition. Furthermore, it is to be ensured that the average hydrogen retention time inside the burner is minimized as much as possible. This assumes that the axial through-flow velocity of the hydrogen-air mixture which is formed inside the burner is very high.

For realizing such a hydrogen-air mixing inside the burner, it is preferable to feed into the swirl chamber of the swirl generator a multiplicity of individual hydrogen flows in a circular distribution, in a manner distributed around the burner axis. The flow feed of hydrogen on one hand is carried out subject to an effective mixing through with combustion feed air, on the other hand it is necessary to largely maintain the flow structure which is formed along the burner up to the burner outlet, i.e., in the case of the provision of a mixer tube, up to the downstream end of the mixer tube, i.e., the flow impulse of the hydrogen-air mixture flow which is formed along the burner is to be established exactly such that the hydrogen-air flow which is formed bursts open at the burner outlet and gets to ignite and finally to combust within the limits of the backflow zone which is formed. A flow impulse which is adapted according to the flow conditions and also to the burner length is a precondition for avoiding spontaneous ignition phenomena and backflashes which occur inside the burner and which are also significantly responsible for emission of pollutants.

For further description of methods according to the present invention and also of exemplary devices which are formed according to the present invention, for combustion of fuel, which contains hydrogen or consists of hydrogen, with a burner, refer to the subsequent embodiments with reference to the concrete exemplary embodiments.

BRIEF DESCRIPTION OF THE DRAWINGS

The invention is exemplarily described below based on exemplary embodiments with reference to the drawings, without limitation of the general inventive idea. In the drawings.

DETAILED DESCRIPTION OF EXEMPLARY EMBODIMENTS

Figure 1:
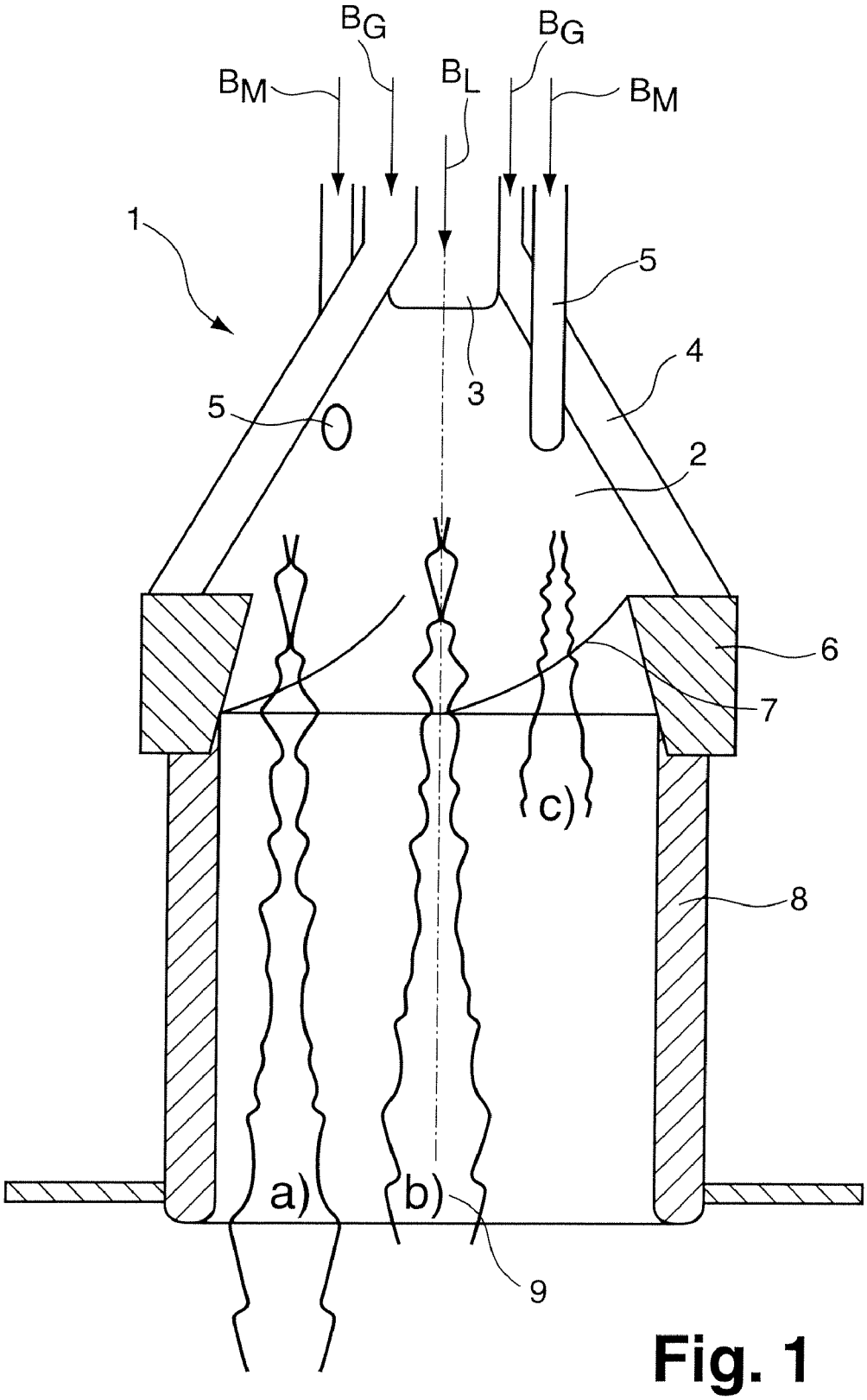
FIG. 1 shows a schematized longitudinal section through a premix burner arrangement with differently formed flow structures for feed of hydrogen into the burner.
Figure 2:
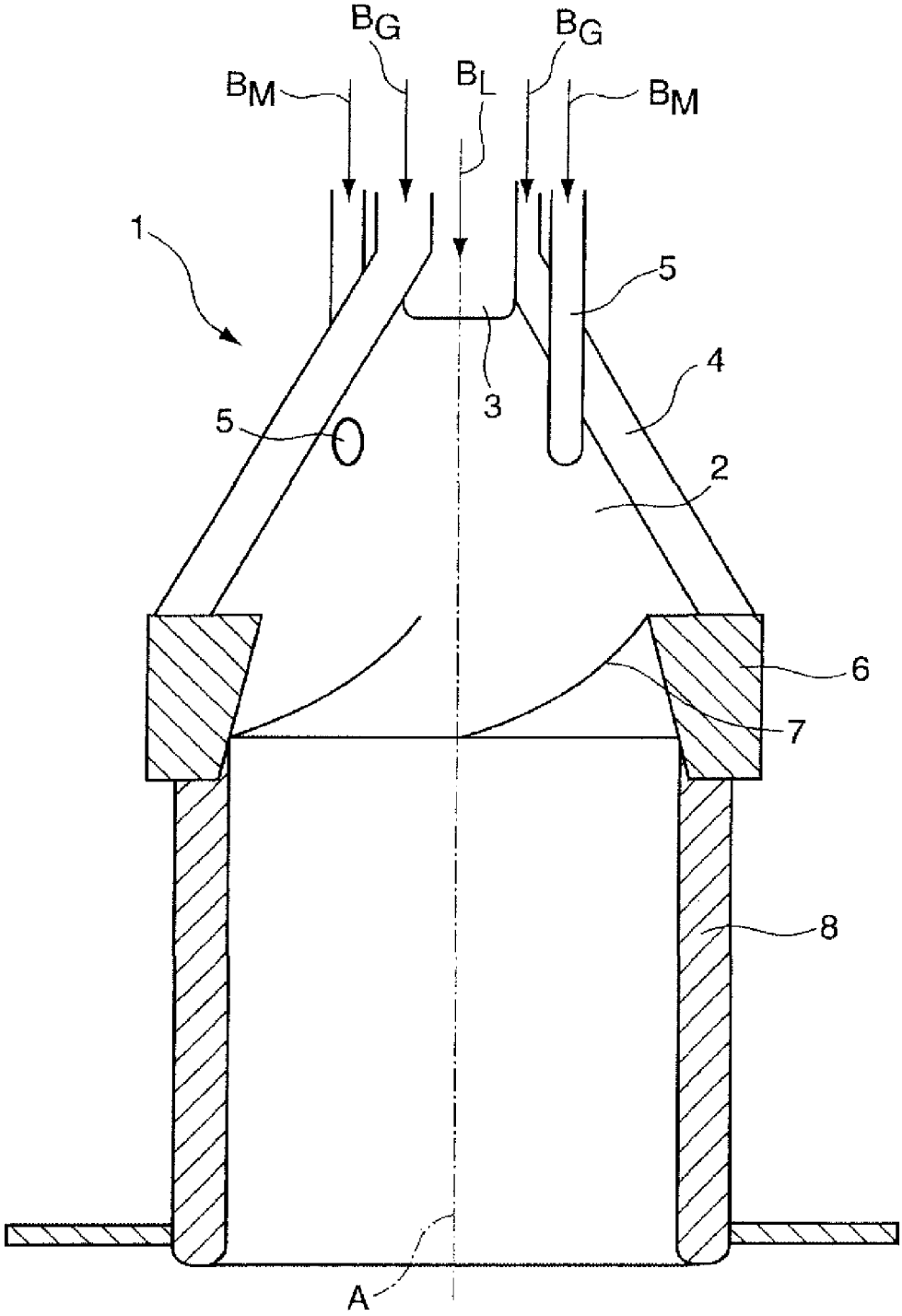
Fig. 2 (Prior art)
FIG. 2 shows a longitudinal section through a premix burner arrangement according to the prior art.
Figure 3:
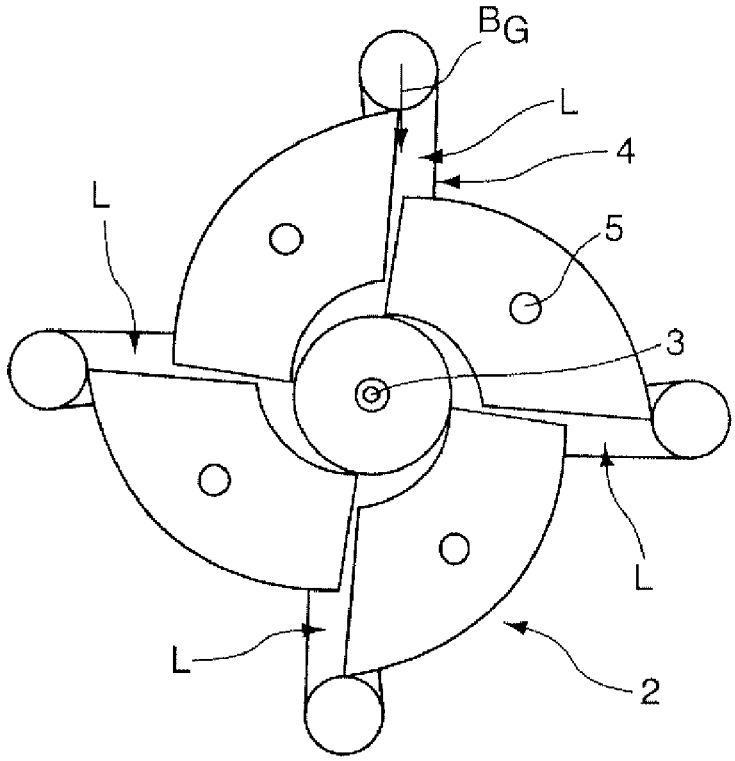
Fig. 3 (Prior art)
FIG. 3 shows a cross section through a premix burner arrangement according to the prior art.

The ideal flow conditions which are formed inside the burner, under which hydrogen, or fuel which contains hydrogen, are to be fed into the inside of the burner, are to be explained in detail with reference to the longitudinal section which is shown in FIG. 1 through a premix burner with a swirl generator 1, a transition piece 6, and also a subsequent mixer tube 8. For feed of hydrogen, a multiplicity of feed pipes 5 are provided, of which only two are shown in FIG. 1, which are coaxially arranged around the burner axis A. The additional devices for feeding fuel, which are otherwise already described with reference to FIG. 2, are briefly referred to only for reasons of completeness. In this way, it is possible to inject liquid fuel, preferably crude oil $B_L$, through a centrally disposed fuel nozzle 3, and similarly fuel pipes, which are provided along the air inlet slots 4, allow the feed of gaseous fuel $B_G$, such as natural gas. Depending upon mode of operation and availability of the diverse fuel types, it is possible to supply the premix burner with the respective fuels, combined or individually, and to correspondingly operate it.

With regard to the operation of the premix burner with hydrogen, which is under discussion, it is necessary to introduce a hydrogen flow 9 into the inside of the burner 1 through the individual feed pipes 5 in each case, which flow has a flow impulse in which the flow structure is largely maintained inside the burner, wherein at the same time an efficient as possible mixing through of the hydrogen flow with the combustion air is provided for. Only directly during issue of the hydrogen flow from the burner does the flow pattern burst open so that the hydrogen-air mixture which is formed along the flow 9 is dissipated and is completely combusted inside the combustion chamber.

This flow case is shown in FIG. 1 in the exemplary case b. The hydrogen flow 9, however, provides a larger flow impulse, i.e., the hydrogen flow inter alia is introduced at greater flow velocity from the feed pipes 5 into the combustion chamber, so the flow pattern is maintained as well after issue from the burner, i.e., inside the combustion chamber, as this is shown in the exemplary case a. In this case, combustion by way of diffusion occurs, which leads to increased emission of nitrogen oxides. However, if the flow impulse is too small, then the hydrogen flow 9 still bursts open inside the burner, as this is shown in the exemplary case c. In this case, spontaneous ignitions preferably occur inside the burner, particularly as the retention time of hydrogen inside the burner is very high. Furthermore, a flow impulse which is too small leads to a reduced mixing through of the hydrogen flow with the combustion air on account of only a small lateral flow penetration.

Figure 4:
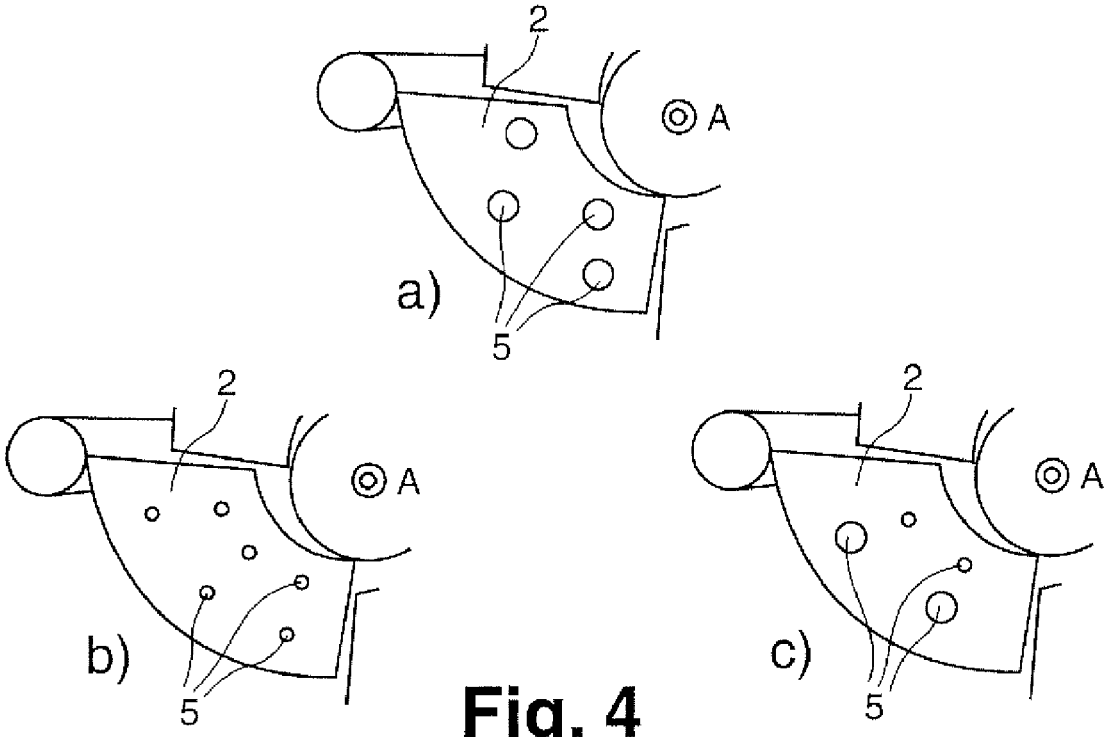
FIG. 4*a-c* show partial cross sectional views through a swirl shell with different configurations for feed of hydrogen.

In addition to the previously described selection of a flow impulse, which is oriented in the flow direction, of the hydrogen flow which is introduced into the burner, it is also necessary to create a hydrogen-air mixture formation which is distributed as spatially homogenously as possible around the burner axis. For this purpose, feed pipes 5 for the injection of hydrogen are provided in the swirl shells 2 which define the swirl chamber of the swirl generator 1, according to the illustrations in FIGS. 4*a* to *c*. Basically, it is particularly advantageous to form the pipe diameter of the feed pipes 5 smaller than in the case of the hitherto known feed of low-calorific or medium-calorific fuels. In FIGS. 4*a* to *c*, a partial cross sectional view through a swirl shell 2 is shown in each case, in which different arrangements of feed pipes 5, through which hydrogen is fed into the swirl chamber, are provided. In FIG. 4*a*, four feed pipes 5 are provided, which, with regard to the burner axis A, are differently positioned both in a radial and in a circular arrangement. The exemplary embodiment according to FIG. 4*b* provides a plurality of feed pipes 5 which are dimensioned smaller in the pipe cross section and which are largely concentrically arranged around the burner axis A in each case. The exemplary embodiment according to FIG. 4*c* provides the selection of differently sized dimensioned feed pipes 5, wherein the radially outer feed pipes 5 have a larger pipe cross section than the inner ones. This results in the flow stream of hydrogen increasing with increasing distance to the burner axis A.

Naturally, further shape and arrangement possibilities of feed pipes 5 inside the respective swirl shell 2 are also possible.

For delivering the hydrogen flow from the respective feed pipes 5, suitable nozzles are preferably to be provided, which in the simplest case are formed as simple orifice nozzles or in the form of suitable Venturi nozzles or similar nozzle arrangements. In this way, it is possible by a suitable nozzle selection to influence the flow pattern of the hydrogen flow which is formed in the burner, for example for forming a flow with elliptical, rectangular, or triangular shaped flow cross section. In dependence upon the selected flow pattern, the mixing through efficiency of the hydrogen flow with the combustion air which envelops the hydrogen flow can be influenced and improved.

Figure 5:
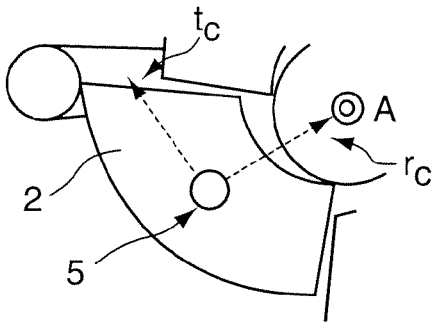
FIG. 5-8 shows detailed cross sections through a swirl shell with differently formed devices for feeding hydrogen.

A further alternative measure for improving the mixing through of the hydrogen flow with the combustion air is shown in FIG. 5, which also shows a partial cross section through a swirl shell 2, in which is provided a feed pipe 5 which is representative of a multiplicity of further feed pipes. The feed pipe 5 has a radial component $r_c$ and/or a tangential component $t_c$. In the case of a radial component $r_c$ which is oriented to the burner axis A, the feed pipe 5 faces the burner axis A in an inclined manner so that the fuel jet which issues from the feed pipe 5 is inclined to the burner axis A by a predeterminable radial angle. It is also possible to adjust the radial component $r_c$ opposite to the burner axis A, wherein in this case the hydrogen jet which issues from the feed pipe 5 is oriented in a manner inclined away from the burner axis A. In this case, it is necessary to select the angle of inclination in such a way that no wetting of the hydrogen flow by the burner wall occurs, especially in the region of the mixer tube. Similarly to the previously described radial component, it is possible, alternatively or in combination, to incline the feed pipe 5 in the circumferential direction of the swirl shell 2 around the burner axis A by a so-called tangential angle. The orientation of the tangential inclination is preferably undertaken in such a way that the hydrogen flow which issues from the feed pipe 5 flows out in the same swirl direction around the burner axis A with which the combustion air also flows through the air inlet slots 4 into the swirl generator 1. The establishment of the tangential component $t_c$ or the tangential angle, as the case may be, moreover, are also to be selected in such a way so that the hydrogen flows which issue from the feed pipes do not impinge directly on adjacent component walls. Furthermore, it is necessary not to unduly extend the average retention time of the hydrogen flow which is discharged into the burner. It is also conceivable to orientate the tangential components opposite to the swirl direction of the combustion air inside the burner, so that the hydrogen flow is fed into the swirl generator in the form of a counter-swirl. In this way, the degree of mixing through of hydrogen and combustion air can also be significantly increased.

Figure 6:
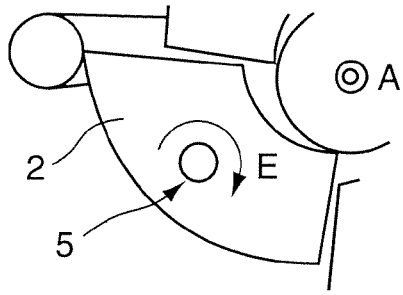

The impressing of a swirl E along the hydrogen flow provides a further alternative measure for increasing the mixing through of hydrogen with combustion air. A feed pipe 5, which is representative for further feed pipes is shown in FIG. 6, from which feed pipe a hydrogen flow issues, provides a swirl E which is oriented in the clockwise direction (see arrow symbol). Naturally, it is possible to arrange the orientation of the swirl E anticlockwise. For example, slot-like contours which extend helically inside the feed pipe 5 serve to generate a swirl, as they are provided, for example, in a gun barrel. Corresponding flow guide vanes, which impress the swirl in the flow, can also be provided in the region of the flow outlet of the feed pipe 5. By impressing a swirl in the hydrogen flow, the lateral mixing through effect with the enveloping combustion air can be appreciably improved in an advantageous way without increasing in the process the average retention time of hydrogen inside the burner, which is to be minimized. On the basis of a large number of trials, it has become apparent that the swirl is to be established with a swirl ratio $\Omega$ of very much less than 1, preferably less than 0.5, wherein $\Omega$ is the ratio of the axial flow of the tangential flow moment to the axial flow of the axial flow moment. In this case, breakdowns of the vortices are largely avoided.

Figure 7:
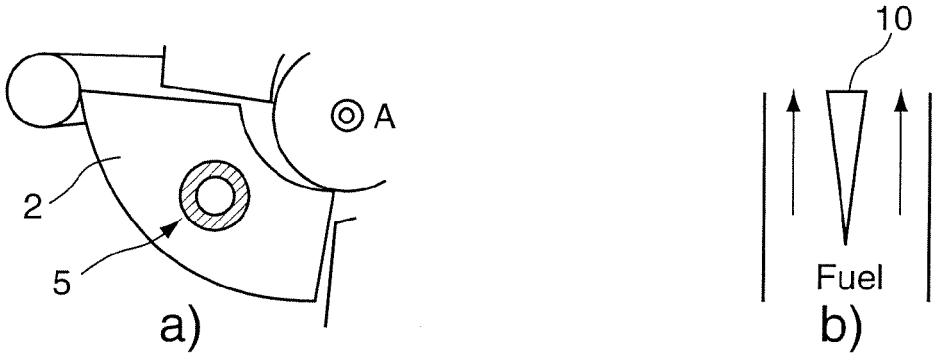

A further alternative measure for improving the mixing through characteristics of a hydrogen flow with the enveloping combustion air is shown in FIGS. 7*a, b*. In this case, the feed pipe 5 is formed as an annular pipe 11 or has an annular outlet geometry at the pipe outlet, as the case may be, through which the hydrogen flow enters the swirl generator. By means of the annularly formed hydrogen flow, its surface is enlarged compared with a standard flow as it is to be produced from a simple single-orifice opening, and is able to be mixed through more efficiently with the enveloping combustion air as a result of it.

It is to be noted at this point that the annular hydrogen flow for further improving the mixing through conditions can be optionally combined with the previously described measures for improving the mixing through between hydrogen and combustion air.

A longitudinal section through the outlet region of a feed pipe 5 is shown in FIG. 7*b*, in which a wedge-shaped displacement component 10 is introduced, by which the hydrogen flow which issues from the feed pipe 5 issues with a predeterminable divergence.

Figure 8:
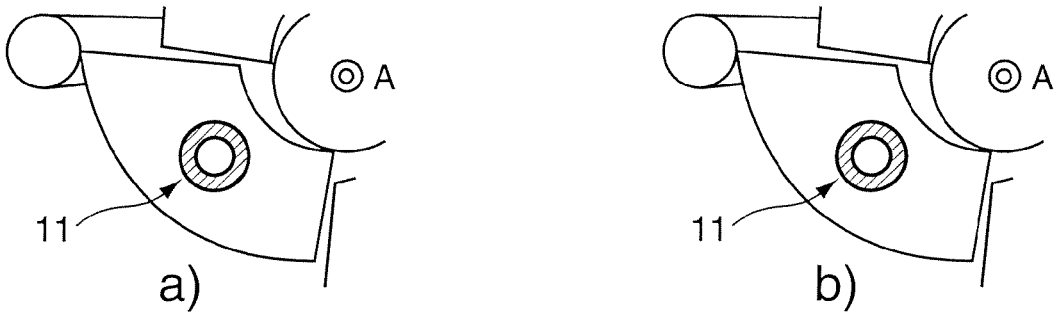

It is to be assumed in the exemplary embodiment according to FIG. 8*a* that the annularly dark hatched section 11 of the feed pipe 5 is that section from which hydrogen issues. The light-colored, middle circular section corresponds to an air feed pipe, from which air is delivered, which is enveloped by the annular hydrogen flow. The reverse case is shown in the exemplary embodiment according to FIG. 8*b*. In this case, hydrogen in the form of a hydrogen flow issues from the inner light-colored flow section, which is enveloped by a circular, annular air flow 11. It has been proved to be especially advantageous that the flow velocity, at which the air flow issues from the respective flow sections of the feed pipe 5 in each case, is to be selected greater than that velocity at which the combustion air axially flows through the burner. By means of this measure, the average retention time of the hydrogen inside the burner can be appreciably reduced, and, for another thing, the mixing through rate can be improved.

Instead of a homogenous annular flow, the arrangement of a multiplicity of small flow passages which are arranged along an annular form provides a measure which still further improves the degree of mixing through, through which flow passages air flows out and forms an annular flow which circularly envelops a hydrogen flow which is formed centrally to the annular form.

It is common to all the aforementioned possibilities of feed of a hydrogen flow into the inside of a premix burner, that the hydrogen flow which is delivered into the inside of the burner does not come into contact with the walls of burner components, particularly as the flow velocity appreciably reduces within boundary layers close to the wall, as a result of which the average retention time of hydrogen inside the burner increases, and also the risk of spontaneous ignitions and backflashes is increased in the same way.

Figure 9:
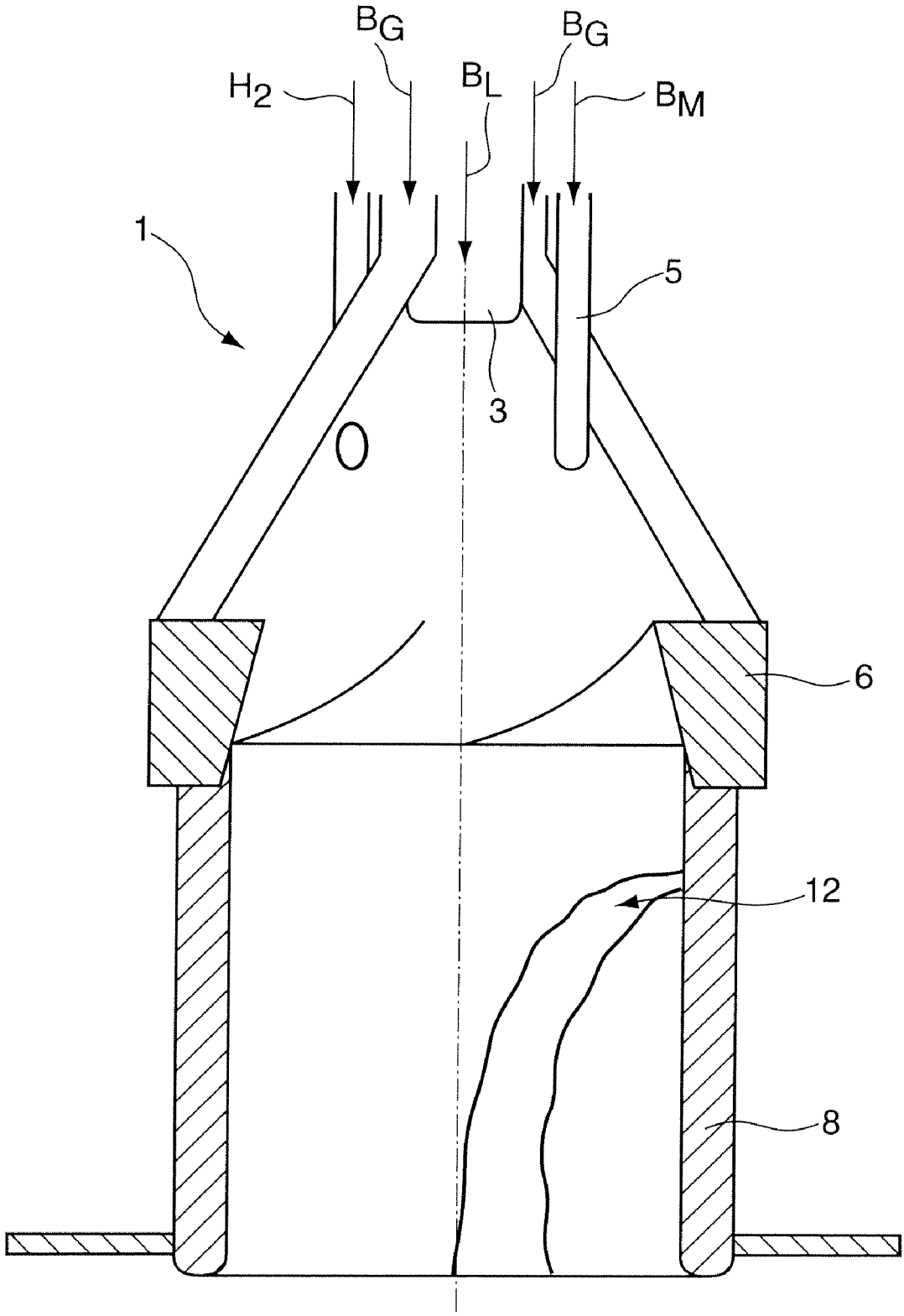
FIG. 9 shows a longitudinal section through a premix burner arrangement with radial feed of hydrogen along the mixer tube, and FIG. 10*a, b* show a longitudinal section with a detailed view through a premix burner with hydrogen feed pipe with integrated catalytic reactor.

A preferred application of the previously described measures for supplying a premix burner with hydrogen as fuel provides the firing of combustion chambers for driving gas turbine plants. A quite customary combination of gas turbine plants with a so-called integrated gasification combined cycle (IGCC) has customary units which decarbonize the fuel, by which hydrogen-enriched fuels can be obtained, which are feedable to the premix burner according to the solution. Within the limits of the decarbonizing, large amounts of nitrogen also arise, under high process pressures, typically about 30 bar, which, furthermore, has temperatures of about 150° C. and below. The nitrogen which is obtained can be admixed with the hydrogen fuel in order to alleviate in this way the risks which are associated with the high reactivity of the hydrogen. For this purpose, already smallest amounts of nitrogen which are to be admixed are adequate in order to noticeably reduce the high reactivity and also the flame velocity of hydrogen. In such an operating mode, furthermore, it has been proved to be advantageous to additionally feed a nitrogen-enriched hydrogen fuel mixture 12 radially to the burner axis A in the region of the mixer tube 8, as this is especially apparent from the schematized longitudinal sectional view through a correspondingly formed premix burner in FIG. 9, the already introduced designations of which are not further elaborated upon to avoid repetitions. By admixing nitrogen within the hydrogen fuel, the flow impulse is increased, as a result of which a sufficiently adequate penetration of the nitrogen-hydrogen flow 12, which is fed radially into the mixing region, is achieved, which nitrogen-hydrogen flow is able to be completely mixed through with the combustion air before the flow reaches the combustion chamber. Moreover, the reactivity of the hydrogen is noticeably reduced by the admixing of $N_2$. Alternatively to or in combination with the aforementioned measure for reducing $H_2$ reactivity, it is opportune to admix nitrogen to the combustion air which enters the burner through the tangential air inlet slots. By means of this, the oxygen portion is reduced, and in this way the reactivity of the hydrogen is influenced. Furthermore, instead of air feed it is conceivable to feed $N_2$ in the exemplary embodiments which are described in FIGS. 8*a* and *b*.

Figure 10:
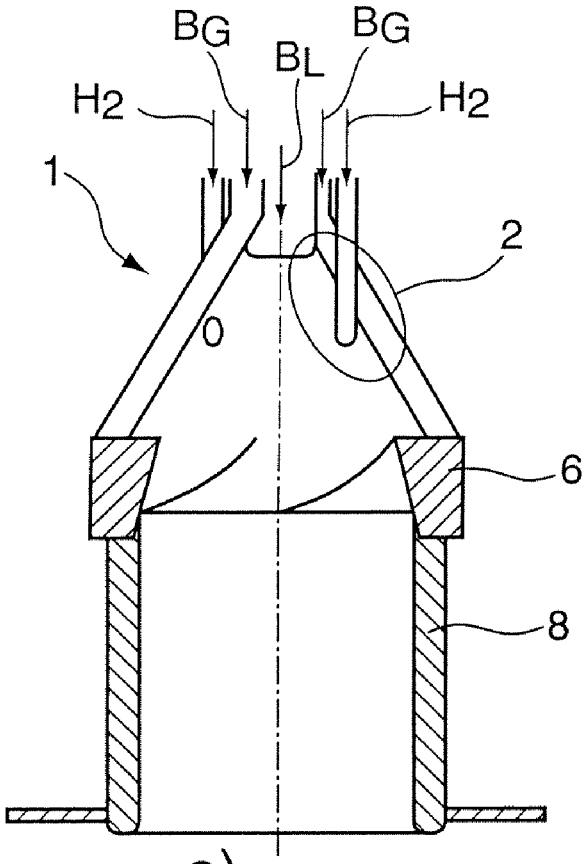
Figure 10:
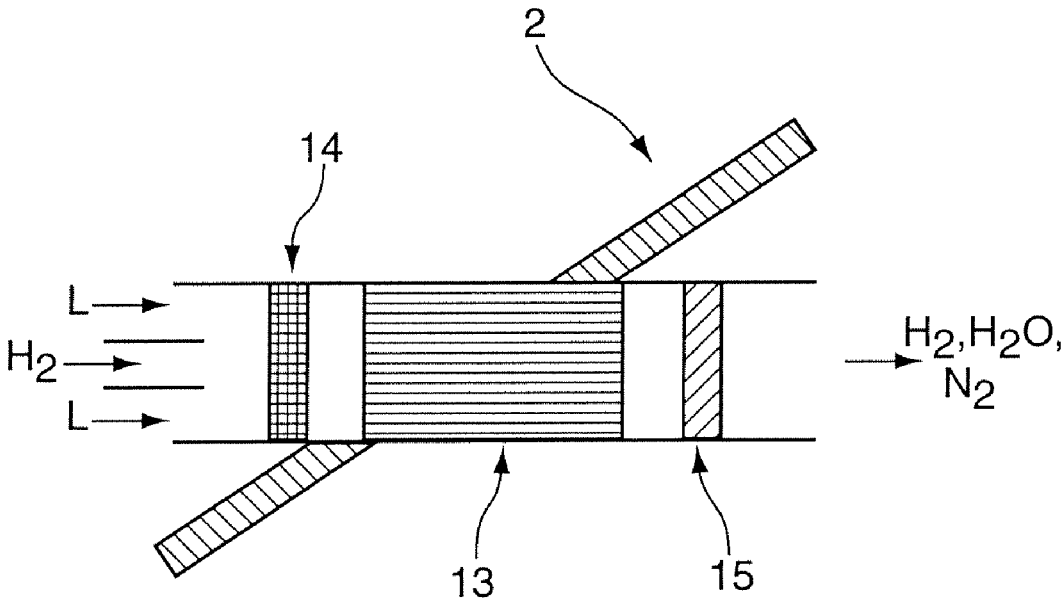

A further, alternative measure to reduce the high reactivity and flame velocity of hydrogen provides the use of catalytic reactors, as this is apparent in detail from the exemplary embodiment in FIG. 10. A catalytic reactor 13, according to the illustration in FIG. 10*b*, is integrated along at least one feed pipe 5, through which hydrogen for combustion inside the premix burner is fed. Hydrogen $H_2$ is fed together with air L along the feed pipe 5 to a mixer unit 14, which mixes through the inflowing air L with the hydrogen $H_2$, before the mixture flows into the catalytic reactor 13. By way of the partially occurring oxidation of the hydrogen, water $H_2O$ is formed, which together with the nitrogen $N_2$ which is contained in the air, and also with the unoxidized hydrogen $H_2$, issues from the catalytic reactor 13 and reaches the inside of the swirl generator 1 via a vortex generator 15. By means of the water vapor which is produced by way of catalyzation, and also by means of the admixing with $N_2$, the reaction kinetics of hydrogen are decisively influenced, as a result of which the risk of backflash is significantly reduced. Furthermore, the fuel flow from the catalytic reactor 13 which enters the inside of the swirl generator 1 has improved mixing characteristics with the combustion air inside the burner. Therefore, fuel rich and fuel lean combustion systems or states, as the case may be, can be more easily controlled and managed.

The aforementioned burner concept enables the combusting of hydrogen and can be adapted in a simple manner in already existing premix burner systems, without in the process changing the burner design which is adapted in an optimized way to burner operation with conventional liquid and/or gaseous fuels. In addition to the design and also arrangement of the feed pipes for feed of hydrogen or fuels which contain hydrogen, which are arranged axially and/or coaxially around the burner axis, the selection of the length of the mixing path is an important design parameter. Mixer tubes typically have a length which is between one and two times the maximum burner diameter. Depending upon the operating mode of the premix burner, a length of the mixer tube can be selected which is suited in a correspondingly optimized manner to the type of fuel.

LIST OF DESIGNATIONS

1 Swirl generator
2 Swirl shell
3 Injection nozzle
4 Air inlet slot
5 Feed pipe
6 Transition piece
7 Guide vane
8 Mixertube
9 Hydrogen flow
10 Wedge-shaped displacement component
11 Annular section
12 Nitrogen-hydrogen fuel mixture
13 Catalytic reactor
14 Mixer unit
15 Vortex generator While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A method for combusting gaseous fuel, the method comprising:

providing a gas turbine having a burner and a combustion chamber, the burner comprising a swirl generator and into which burner liquid fuel can be fed centrally along a burner axis, forming a conical liquid fuel column, and which liquid fuel column is enveloped by, and mixed through with, a rotating combustion air flow which flows tangentially into the swirl generator;

feeding a gaseous fuel having a hydrogen portion of at least 50% inside the swirl generator at least one of axially and coaxially to the burner axis, forming a fuel flow with a spatially defined flow pattern which is maintained inside the burner;

mixing the fuel flow thoroughly with combustion air to form an air-fuel mixture;

bursting open the air-fuel mixture in the region of the burner outlet, including forming a backflow zone in the combustion chamber; and completely combusting the air-fuel mixture inside the combustion chamber while maintaining the backflow zone.

2. The method as claimed in claim 1, wherein feeding fuel comprises feeding a multiplicity of individual fuel flows in a circular distribution around and/or into the rotating combustion air flow.

3. The method as claimed in claim 1, wherein feeding fuel comprises feeding a multiplicity of individual fuel flows in a radial distribution relative to the rotating combustion air flow.

4. The method as claimed in claim 3, wherein feeding comprises feeding a radially outer fuel flow into the swirl generator with a larger fuel flow than a radially inner fuel flow.

5. The method as claimed in claim 1, wherein feeding comprises feeding so that the fuel flow bursts open directly upstream to the burner outlet.

6. The method as claimed in claim 1, wherein feeding fuel comprises feeding the fuel flow with a circular, elliptical, annular, rectangular, or triangular flow cross section.

7. The method as claimed in claim 1, wherein feeding fuel comprises feeding into the swirl generator with a flow impulse adapted to the flow impulse of the rotating combustion air flow which propagates along the swirl generator.

8. The method as claimed in claim 1, wherein feeding fuel comprises feeding fuel in an inclined manner with a radial component $r_c$ which is oriented towards or away from the burner axis.

9. The method as claimed in claim 1, wherein feeding fuel comprises feeding with a tangential component $t_c$ in or opposite to the direction of rotation of the combustion air flow flowing into the swirl generator.

10. The method as claimed in claim 1, wherein feeding fuel comprises feeding with a swirl around a flow direction of the fuel.

11. The method as claimed in claim 1, wherein mixing comprises feeding an air flow; and wherein feeding fuel comprises either (a) feeding fuel with an annular flow cross section which envelops the air flow with the same flow direction as the fuel flow, or (b) a circular flow cross section which is enveloped by the air flow, and feeding an air flow comprises feeding an annular air flow.

12. The method as claimed in claim 11, further comprising:

feeding a combustion air flow into the swirl generator; and wherein feeding an air flow comprises feeding with a higher flow velocity than the combustion air flow.

13. The method as claimed in claim 1, further comprising:

at least partially catalytically oxidizing the fuel before entry into the swirl generator.

14. The method as claimed in claim 1, further comprising:

admixing $N_2$ with the gaseous fuel.

15. The method as claimed in 1, further comprising:

admixing $N_2$ with the combustion air flow.

16. The method as claimed in claim 1, further comprising:

feeding an $N_2$ flow; and wherein feeding fuel comprises either (a) feeding with an annular flow cross section which envelops the $N_2$ flow with the same flow direction as the fuel flow, or (b) feeding with a circular flow cross section, and feeding an $N_2$ flow comprises feeding an annular $N_2$ flow which envelopes the circular fuel flow.

17. A device for combusting fuel, the fuel containing hydrogen, comprising:

a burner including a swirl generator, means for feeding fuel, and means for feeding combustion air into the swirl generator, the burner having a burner axis;

air inlet slots tangentially bounded by the swirl generator;

first means for feeding liquid fuel along the burner axis;

second means for feeding fuel, positioned along the air inlet slots;

third means for feeding fuel into the inside of the swirl generator at least one of axially and coaxially to the burner axis, the third means for introducing said fuel containing hydrogen;

wherein the swirl generator comprises individual swirl shells which mutually define the air inlet slots which extend tangentially to the swirl generator;

wherein the swirl generator is configured and arranged to form a backflow zone downstream of the burner near the burner outlet; and wherein the third means comprises a plurality of fuel pipes fastened to each swirl shell;

wherein the plurality of fuel pipes are arranged individually or in groups with different radial distances to the burner axis, wherein fuel pipes with a greater radial distance have a larger pipe diameter than fuel pipes which lie closer to the burner axis.

18. A device for combusting fuel, the fuel containing hydrogen, comprising:

a burner including a swirl generator, means for feeding fuel, and means for feeding combustion air into the swirl generator, the burner having a burner axis;

air inlet slots tangentially bounded by the swirl generator;

first means for feeding liquid fuel along the burner axis;

second means for feeding fuel, positioned along the air inlet slots; and third means for feeding fuel into the inside of the swirl generator at least one of axially and coaxially to the burner axis, the third means for introducing said fuel containing hydrogen;

wherein the swirl generator comprises individual swirl shells which mutually define the air inlet slots which extend tangentially to the swirl generator;

wherein the swirl generator is configured and arranged to form a backflow zone downstream of the burner near the burner outlet; and wherein the third means comprises a fuel pipe fastened on the swirl generator and inclined at a direction including a radial component relative to the burner axis, at which component a fuel flow when fed through the fuel pipe propagates toward or away from the burner axis.

19. A device for combusting fuel, the fuel containing hydrogen, comprising:

a burner including a swirl generator, means for feeding fuel, and means for feeding combustion air into the swirl generator, the burner having a burner axis;

air inlet slots tangentially bounded by the swirl generator;

first means for feeding liquid fuel along the burner axis;

second means for feeding fuel, positioned along the air inlet slots; and third means for feeding fuel into the inside of the swirl generator at least one of axially and coaxially to the burner axis, the third means for introducing said fuel containing hydrogen;

wherein the swirl generator comprises individual swirl shells which mutually define the air inlet slots which extend tangentially to the swirl generator;

wherein the swirl generator is configured and arranged to form a backflow zone downstream of the burner near the burner outlet; and wherein the third means comprises a fuel pipe fastened on the swirl generator located at a tangential component $t_c$, at which a fuel flow when fed through the fuel pipe propagates in or opposite a direction of rotation of the combustion air flowing into the swirl generator when imposed by the swirl generator.

20. A device for combusting fuel, the fuel containing hydrogen, comprising:

a burner including a swirl generator, means for feeding fuel, and means for feeding combustion air into the swirl generator, the burner having a burner axis;

wherein the swirl generator is configured and arranged to form a backflow zone downstream of the burner near the burner outlet;

air inlet slots tangentially bounded by the swirl generator;

first means for feeding liquid fuel along the burner axis;

second means for feeding fuel, positioned along the air inlet slots; and third means for feeding fuel into the inside of the swirl generator at least one of axially and coaxially to the burner axis, the third means for introducing said fuel containing hydrogen;

wherein the third means is also for impressing a swirl on the fuel flow which issues therefrom.

21. The device as claimed in claim 17, further comprising:

a mixer tube downstream of the swirl generator, a downstream end of the mixer tube forming a burner outlet.

22. The method as claimed in claim 1, wherein the fuel consists of hydrogen.

23. The device as claimed in claim 18, further comprising:

a mixer tube downstream of the swirl generator, a downstream end of the mixer tube forming a burner outlet.

24. The device as claimed in claim 19, further comprising:

a mixer tube downstream of the swirl generator, a downstream end of the mixer tube forming a burner outlet.

25. The device as claimed in claim 20, further comprising:

a mixer tube downstream of the swirl generator, a downstream end of the mixer tube forming a burner outlet.

* * * * *